US005123973A

United States Patent [19]

Scott et al.

[11] Patent Number: 5,123,973

[45] Date of Patent: Jun. 23, 1992

[54] ALUMINUM ALLOY EXTRUSION AND METHOD OF PRODUCING

[75] Inventors: Gerald D. Scott; James A. Brock; Thomas J. Klemp, all of Massena, N.Y.

[73] Assignee: Aluminum Company of America, Pittsburgh, Pa.

[21] Appl. No.: 661,587

[22] Filed: Feb. 26, 1991

[51] Int. Cl.[5] ..... C22F 1/04

[52] U.S. Cl. ..... 148/690; 148/417; 148/439; 148/693; 420/534; 420/537; 420/549

[58] Field of Search ..... 148/11.5 A, 12.7 A, 148/159, 417, 439; 420/534, 537, 549

[56] References Cited

U.S. PATENT DOCUMENTS 4,412,870 11/1983 Vernam et al. ..... 148/11.5 A
4,434,014 2/1984 Smith ..... 148/159

FOREIGN PATENT DOCUMENTS 59-193238 11/1984 Japan ..... 148/439
64-075643 3/1989 Japan .

*Primary Examiner*—R. Dean
*Assistant Examiner*—Robert R. Koehler
*Attorney, Agent, or Firm*—Andrew Alexander; Glenn E. Klepac

[57] ABSTRACT

A worked rod extrusion product for fabricating into products having high wear resistance surfaces, the product comprised of 11 to 13.5 wt. % Si, 0.5 to 1.45 wt % Cu, 0.8 to 3 wt. % Mg, 0.5 to 2.95 wt. % Ni, max 1 wt. % Fe, max 0.1 wt. % Cr, max 0.25 wt. % Zn, the balance aluminum, incidental elements and impurities.

51 Claims, No Drawings

ALUMINUM ALLOY EXTRUSION AND METHOD OF PRODUCING

INTRODUCTION

This invention relates to wrought aluminum alloy rod and bar stock and more particularly it relates to a AA4000 type, e.g. AA4032 type aluminum alloy wrought extruded rod product for fabricating into components having a high wear resistant surface.

In the production of transmission valves, air compressor pistons, internal combustion engine pistons, and automotive brake components, and other applications where surfaces are exposed to friction and wear, aluminum alloys such as AA6262 and 6061 can be used but usually only after a hard anodic coating has been applied. This imparts to the wear surface a hard aluminum oxide coating which has good wear resistance characteristics. However, applying such coating adds expense because of the extra anodization steps. Another approach would be to apply a hard steel liner but this too is expensive.

Thus, it would be highly desirable to provide such aluminum components having high wear characteristics without the anodization steps.

The subject invention provides aluminum alloy rod for fabricating into components having high wear resistant surface without the need for anodization. AA4032 which has registered limits of 11 to 13.5 wt. % Si, 1 wt. % max Fe, 0.5 to 1.3 wt. % Cu, 0.8 to 1.3 wt. % Mg, 0.1 wt. % Cr, 0.5 to 1.3 wt. % Ni, 0.25 wt. % Zn can be used for such components without the need for anodizing.

SUMMARY OF THE INVENTION

It is an object of this invention to provide an extruded rod product which has been worked after extruding.

It is another object of this invention to provide a rod product which has been first extruded and then further wrought.

It is another object of this invention to provide a cold worked extruded rod product suitable for fabricating into products having high wear resistant surfaces.

It is another object of this invention to provide cold worked extruded rod from a AA4000 type aluminum alloy.

These and other objects of this invention will be apparent from a reading of the specification and accompanying drawings.

In accordance with these objects, there is provided a wrought extruded rod product comprised of 11 to 13.5 wt. % Si, 0.5 to 2.0 wt. % Cu, 0.8 to 2.0 wt. % Mg, 0.5 to 3.0 wt. % Ni, max 1 wt. % Fe, max. 0.1 wt. % Cr, max. 0.25 wt. % Zn, the balance aluminum, incidental elements and impurities.

DETAILED DESCRIPTION OF THE PREFERRED EMBODIMENTS

As noted, the alloy of the present invention comprises 11 to 13.5 wt. % Si, 0.5 to 1.45 wt. % Cu, 0.8 to 3 wt. % Mg, 0.5 to 2.95 wt. % Ni, max 1 wt. % Fe, max. 0.1 wt. % Cr, max. 0.25 wt. % Zn, the balance aluminum, incidental elements and impurities. The impurities are preferably controlled to provide not more than 0.75 wt. % Fe and 0.1 wt. % Cr, max 0.2 wt. % Zn, and lower limits for such elements can be 0.01 wt. %. Other impurities are preferably limited to 0.05 wt. % each and the combination of other impurities preferably not exceeding 0.15 wt. %.

With respect to the main alloying elements, Si can be in the range of 11 to 13 wt. %, Cu, 0.5 to 1.3 wt. %, Mg, 0.8 to 1.3 wt. %, and Ni, 0.5 to 1.3 wt. %. It is preferred that Si be in the range of 11.3 to 12.9 wt. % , Cu, in the range of 0.6 to 1.2 wt. %, Mg in the range of 0.8 to 1.5 wt. %, Ni, in the range of 0.5 to 1.5 wt. % This preference is based on achieving a uniform, equiaxed structure substantially free of coarse intermetallics and primary silicon. In a further preferred alloy in accordance with the invention, Sr is present in the range of about 0.01 to 0.5 wt. %, preferably in the range of 0.015 to 0.4 wt. %. with typical amounts being about 0.025 wt. %. Sr is desirable because it provides for structural modification of the silicon particles or silicon containing particles. Because of the number of alloying elements and the interaction with each other, it is indeed quite surprising that a refinement of insoluble constituent is obtained. This can aid homogenization by reducing the time and temperature required.

The alloy can contain at least one of the elements selected from B, V, Sc, Mn, Er, Zn, Ti, and Fe, the elements having the ranges up to 0.2 wt. % B, 0.3 wt. % max V, 0.3 wt. % max Sc, 1 wt. % max Mn, 0.2 wt. % max Er, 0.2 wt. % max Zn, 0.25 wt. % max Ti and 1 wt. % max Fe as noted. When any of these elements are used or is present in the alloy, the lower limit for such element is not normally lower than 0.05 wt. %.

As well as providing the alloy with controlled amounts of alloying elements as described herein, it is preferred that the alloy product be prepared according to specific method steps in order to provide the desirable characteristics at reasonable cost. Thus the alloy described herein can be provided as an ingot or billet for fabrication into a suitable wrought product by techniques currently employed in the art, with continuous casting being preferred. The cast ingot may be preliminarily worked or shaped to provide suitable stock for subsequent working operations. Prior to the principal working operations, the alloy stock is preferably subjected to homogenization, preferably at metal temperatures in the range of 900° to 1100° F. for a time period of at least one hour, in order to dissolve magnesium and silicon or other soluble elements, and homogenize the internal structure of the metal. A preferred time period is 2 hours or more in the homogenization temperature range. Normally, the heat up and homogenizing treatment does not have to extend for more than 24 hours; however, longer times are not normally detrimental. A time of 12 to 20 hours at the homogenization temperature has been found to be quite suitable. For example, a typical homogenization treatment is 18 hours at 950° F. In addition to dissolving constituent to promote workability or formability, this homogenization treatment is important in that it is believed to coalesce any undissolved constituents such as those formed by iron and silicon.

After the homogenizing treatment, the metal can be rolled or extruded or otherwise subjected to working operations to produce stock such as sheet or extrusions or other stock suitable for shaping into the end product. To produce a sheet-type product, a body of the alloy is preferably hot rolled to a thickness ranging from about 0.1 to about 0.16 or 0.2 inch, typically around 0.14 inch. For hot rolling or extruding purposes, the temperature should be in the range of 1000° F. down to 400° F. Preferably, the metal temperature initially is in the range of 800° to 1000° F. and the temperature at the completion is preferably 400° to 600° F.

When the intended use is a sheet product normally operations other than hot rolling are unnecessary for this rather thick sheet of, typically, 0.1 to 0.25 inch.

When the intended use is wrought rod or bar, for fabricating into products where high wear resistance is important such as transmission valves, pistons such as air compressors or engine pistons, and other vehicular or other light weight components, then it is preferred that each rod be carefully fabricated to provide for the required machinability. By rod as used herein is meant to include cross-sectional configurations including hexagonal, square, rectangular and round configurations as well as gauges in such including wire gauges. Thus, in one process of the invention, the ingot is extruded to a billet size suitable for hot rolling. Such size can be in the range of about 1" to 10" diameters, for example 6" diameter. Thereafter the extruded billet can be hot rolled at a temperature in the range of 600° to 800° F. to provide a hot rolled rod which can have a diameter of from ¼ to 1 inch. The hot rolling of the rod provides a reduction in cross-section of about 65 to 99%. The hot rolled rod may then be drawn to a rod or bar size useful for fabricating into products or it may be drawn to a slightly larger diameter than required, e.g., 0.1 to 10% larger and typically 0.25 to about 2% larger. Thereafter the drawn rod is solution heat treated to substantially dissolve soluble elements. The solution heat treatment is preferably accomplished at a temperature in the range of 900° to 1000° F. To further provide the desired properties necessary to the final product, the rod is rapidly quenched to prevent or minimize uncontrolled precipitation. Thus, it is preferred in the practice of the present invention that the quenching rate be at least 10° F./sec. from solution temperature to a temperature of about 350° F. or lower. A preferred quenching rate is at least 300° F./sec. in the temperature range of 750° F. or more to 550° F. or less. After the metal has reached a temperature of about 350° F., it may then be air cooled. Suitable rates can be obtained with a water quench. After quenching, if the rod is of the type which is hot rolled to a slightly larger diameter, it is then redrawn to a size suitable for machining or fabricating. The redrawing operation, imparts an amount of cold work which increases strength properties suitable to the final product. In addition, if the rod is in coiled form, the redrawing may be used as a straightening operation in order to provide straight lengths of wrought rod having uniform properties. Prior to, or after straightening the rod may be subjected to etching, burnishing or polishing operations or other forms of surface modification as desired.

To provide the strength necessary to the final product, the rod product can be aged from about 6 to 12 hours in a temperature range of 225° to 400° F. The rod can be provided in any one of a number of tempers selected from the following types T3, T351, T4, T451, T6, T651, T8, T851, T9, etc, which are set forth in Aluminum Standards and Data, 1988, published by The Aluminum Association and incorporated herein by reference. The above steps are particularly suitable for small diameter rods, e.g., ¼ to ¾ inch diameter.

When it is desired to produce larger diameter rods, for example, greater than ¾" diameter, the ingot is homogenized and extruded to a billet size as noted above. The billet is then cold drawn (e.g. room temperature) to a diameter suitable for fabricating into end products. Typically, the cold drawing operation provides a reduction in diameter of from 5 to 35%. Thereafter, cold drawn or wrought rod is solution heat treated as noted above. By wrought is meant to include cold, warm or hot working after extruding. Thus, by the term "wrought extruded rod product" is meant a rod product which has been further worked after the extruding operation, usually substantially reducing the diameter of the rod during such working which may include hot rolling or drawing as noted. Warm or hot working can include temperatures up to about 1000° F. The rod may then be stretched to straighten. Further, the straightened rod may be surface finished using a caustic etch, or burnishing or polishing as noted earlier. Aging may be provided as explained herein to provide properties necessary to the end product.

The alloy rod product of the present invention has the advantage that components can be fabricated therefrom having wear resistant surfaces without the extra steps of hard anodizing. This offers economics in making aluminum members useful in various assemblies when said aluminum members are subjected to sliding contact with other members. Examples of such members include pistons for engines or air conditioner compressors, automatic transmission valves or other parts. The present invention provides stock for making such parts by machining, metal working (hammering, squeezing, etc,) or other shaping operations including various other manufacturing techniques. However, now the need for the anodizing step previously used is greatly reduced. Further, the method steps provides highly uniform distribution of silicon particles which aid in the wear resistance.

The rod product has a tensile strength in the range of 40 to 58 ksi and yield strength in the range of 25 to 52 ksi and elongation can range from about 5 to 13%. Thus, there is provided a rod product having good workability, strength, and machinability which can be formed into parts having high wear resistance.

The following examples are still further illustrative of the invention.

EXAMPLE 1

An aluminum base alloy having the composition Si 12.1 wt. %, Fe 0.38 wt. %, Cu 0.93 wt. %, Mn 0.022 wt. %, Mg 1.12 wt. %, Ni 0.89 wt. %, Ti 0.041 wt. %, Zr 0.0023 wt. %, Sr 0.015 wt. % and Cr 0.006 wt. %, the remainder aluminum was cast into a 15" ingot which was homogenized for 15 hours at a temperature set at 950° F. Thereafter, the ingot was extruded at about 700° F. at about 30 fpm to a 6" extrusion and then hot rolled to a 0.875" diameter rod starting at about 850° F. and coiled. The rod was then annealed for 1 ½ hours at about 650° F. and then redrawn to about 0.77" diameter. Thereafter, the rod was solution heat treated about 960° F. for about 20 minutes followed by a cold water quench. The coiled rod was then roll straightened and cut to length. The rod lengths were aged at 340° F. for about 10 hours to provide the rod in a T8 condition. Typical tensile strength for such rod is about 54.5 ksi with yield strengths of about 50.5 ksi and elongation ranging from 5 to 11.5%.

EXAMPLE 2

An ingot having the composition of Example 1 was first homogenized (as in Example 1) and then extruded at about 725° F. and 14 fpm to a rod having 1.125" diameter. Thereafter, it was drawn to 1.007" diameter followed by solution heat treating as in Example 1 except for a soak period of 45 minutes and then cold water quenched. The rod was stretched (about 1.5%) to straighten resulting in a final diameter of 1 inch. Aging was at 330° F. for 10 hours to provide a T651 condition. Properties were similar to those in Example 1.

What is claimed is:

1. A wrought extruded rod product for fabricating into products having high wear resistant surfaces, the product comprising an alloy consisting essentially of 11.3 to 12.9 wt. % Si, 0.5 to 1.45 wt. % Cu, 0.8 to 3 wt. % Mg, 0.5 to 1.3 wt. % Ni, max. 1 wt. % Fe, max. 0.1 wt. % Cr, max. 0.25 wt. % Zn, the balance aluminum, incidental elements and impurities, said rod product being provided in a T8 , T851 or T9 temper.

2. The rod product in accordance with claim 1 wherein the alloy contains 0.01 to 0.5 wt. % Sr.

3. The rod product in accordance with claim 1 wherein the alloy contains 0.8 to 1.3 wt. % Mg.

4. The rod product in accordance with claim 1 wherein the alloy contains 0.015 to 0.4 wt. % Sr.

5. The rod product in accordance with claim 1 wherein the rod product is provided in a T8 or T851 temper.

6. The rod product in accordance with claim 1 wherein the rod product is provided in a T9 temper.

7. A wrought extruded rod product comprised of 11.3 to 12.9 wt. % Si, 0.6 to 1.2 wt. % Cu, 0.8 to 1.5 wt. % Mg, 0.5 to 1.3 wt. % Ni, max 1 wt. % Fe, max 0.1 wt. % Cr, max 0.25 wt. % Zn, the balance aluminum, incidental elements and impurities, the rod provided in a T8 condition.

8. A wrought extruded rod product comprised of 11.3 to 12.9 wt. % Si, 0.6 to 1.2 wt. % Cu, 0.8 to 1.5 wt. % Mg, 0.5 to 1.3 wt. % Ni, 0.01 to 0.5 wt. % Sr, max 1 wt. % Fe, max 0.1 wt. % Cr, max 0.25 wt. % Zn, the balance aluminum incidental elements and impurities, the rod provided in a T9 condition.

9. A method of producing a wrought extruded rod product comprising:

(a) providing a body of aluminum base alloy comprised of 11 to 13.5 wt. % Si, 0.5 to 1.45 wt. % Cu, 0.8 to 3 wt. % Mg, 0.5 to 2.95 wt. % Ni, max. 1 wt. % Fe, max. 0.1 wt. % Cr, max. 0.25 wt. % Zn, the balance aluminum, incidental elements and impurities;

(b) extruding or hot rolling said body to provide a billet for drawing;

(c) drawing said billet into a rod; and (d) solution heat treating, quenching and aging said rod to a wrought extruded rod product having a substantially stable level of mechanical properties.

10. The method in accordance with claim 9 wherein the alloy contains 0.01 to 0.5 wt. % Sr.

11. The method in accordance with claim 9 wherein the alloy contains 11.3 to 12.9 wt. % Si.

12. The rod product in accordance with claim 9 wherein the alloy contains 0.8 to 1.3 wt. % Mg.

13. The rod product in accordance with claim 9 wherein the alloy contains 0.5 to 1.3 wt. % Ni.

14. The rod product in accordance with claim 9 wherein the alloy contains 0.015 to 0.4 wt. % Sr.

15. The method in accordance with claim 9 wherein the rod is provided in T4, T451, T6 or T651 condition.

16. The method in accordance with claim 9 wherein the body is extruded in a temperature range of 550° to 850° F.

17. The method in accordance with claim 9 wherein the billet is hot rolled in step (b) to provide a hot rolled billet.

18. The method in accordance with claim 9 wherein the hot rolled billet is drawn to further reduce its diameter.

19. The method in accordance with claim 18 wherein the hot rolled and drawn billet is solution heat treated and quenched to form a rod product.

20. The method in accordance with claim 19 wherein the solution heat treated and quenched rod product is subjected to a second drawing operation to provide a redrawn rod product.

21. The method in accordance with claim 20 wherein the second drawn rod product is aged.

22. A method of producing a worked rod extrusion product for fabricating into parts having high surface wear resistance comprising:

(a) providing a body of aluminum base alloy comprised of 11 to 13.5 wt. % Si, 0.5 to 1.3 wt. % Cu, 0.8 to 1.3 wt. % Mg, 0.5 to 1.3 wt. % Ni, max 1 wt. % Fe, max 0.1 wt. % Cr, max 0.25 wt. % Zn, 0.015 to 0.4 wt. % Sr, the balance aluminum, incidental elements and impurities, (b) extruding said body in a temperature range of 400° to 1050° F. to provide an extrusion, (c) hot rolling said extrusion to a hot rolled rod suitable for drawing, the hot rolling performed in a temperature range of 600° to 800° F., (d) drawing said hot rolled rod to provide a reduced diameter rod, (e) solution heat treating and quenching said reduced diameter rod, (f) redrawing said reduced diameter rod to provide a redrawn rod, (g) aging said redrawn rod.

23. The method in accordance with claim 22 wherein said redrawn rod is aged to a T3, T351, T8 or T851 condition.

24. A method of producing a worked rod extrusion product for fabricating into parts having high surface wear resistance comprising:

(a) providing a body of aluminum base alloy comprised of 11 to 13.5 wt. % Si, 0.5 to 1.3 wt. % Cu, 0.8 to 1.3 wt. % Mg, 0.5 to 1.3 wt. % Ni, max 1 wt. % Fe, max 0.1 wt. % Cr, max 0.25 wt. % Zn, 0.015 to 0.4 wt. % Sr, the balance aluminum, incidental elements and impurities, (b) extruding said body in a temperature range of 400° to 1050° F. to provide an extrusion, (c) hot rolling said extrusion to a hot rolled rod suitable for drawing, the hot rolling performed in a temperature range of 600° to 800° F., (d) drawing said hot rolled rod to provide a reduced diameter, (e) solution heat treating and quenching said reduced diameter rod, (f) aging said rod.

25. The method in accordance with claim 24 wherein said rod is aged to a T4, T451, T6 or T651 condition.

26. In a method of producing a rod product suitable for forming into parts having high resistance to surface wear, said method comprising the steps of:

(a) providing an aluminum alloy body;

(b) extruding said body to produce an extrusion for drawing;

(c) drawing said extrusion to a rod; and (d) solution heat treating, quenching and aging said rod to form a rod product;

the improvement wherein said aluminum alloy body comprises 11 to 13.5 wt. Si, 0.5 to 1.45 wt. % Cu, 0.8 to 3 wt. % Mg, 0.5 to 2.95 wt. % Ni, max. 1 wt. % Fe, max. 0.1 wt. % Cr, max. 0.2 wt. % Zn, the balance aluminum, incidental elements and impurities.

27. The method in accordance with claim 26 wherein said body comprises 11.3 to 12.9 wt. % Si, 0.6 to 1.2 wt. % Cu, 0.8 to 1.5 wt. % Mg, 0.5 to 1.3 wt. % Ni and 0.01 to 0.5 wt. % Sr.

28. The method in accordance with claim 27 wherein said body comprises 0.015 to 0.4 wt. % Sr.

29. The method in accordance with claim 26 wherein step (a) further comprises homogenizing said body at a metal temperature of 900°-1100° F. for a least one hour.

30. The method in accordance with claim 29 wherein said homogenizing is performed for two hours or more.

31. The method in accordance with claim 29 wherein said homogenizing is performed for 12 to 20 hours.

32. The method in accordance with claim 26 further comprising:

(e) cutting said rod product to a desired length.

33. The method in accordance with claim 26 wherein said method consists essentially of the steps recited, said rod product having good surface wear resistance without any anodization.

34. The method in accordance with claim 26 wherein said extruding in step (b) is performed at a temperature of 400°-1050° F.

35. The method in accordance with claim 26 further comprising:

(e) hot rolling said extrusion at a temperature of 600°-800° F. after step (b) and before step (c).

36. An aluminum alloy rod product formed by the method of claim 26, said rod product being provided in a T8, T851 or T9 temper.

37. An aluminum alloy piston or valve formed by the method of claim 32, said piston or valve being provided in a T8, T851 or T9 temper and having good surface wear resistance without anodization.

38. A method of producing a rod product suitable for forming into parts having high resistance to surface wear, said method comprising the steps of:

(a) providing an aluminum alloy body;

(b) extruding said body to produce an extrusion for drawing;

(c) drawing said extrusion to a rod;

(d) solution heat treating and quenching said rod to form a rod product;

(e) redrawing said rod product to form a redrawn rod; and (f) again said redrawn rod;

the improvement wherein said aluminum alloy body comprises 11 to 13.5 wt. % Si, 0.5 to 1.45 wt. % Cu, 0.8 to 3 wt. % Mg, 0.5 to 2.95 wt. % Ni, max. 1 wt. % Fe, max. 0.1 wt. % Cr, max. 0.2 wt. % Zn, the balance aluminum, incidental elements and impurities.

39. The method in accordance with claim 38 wherein said body comprises 11.3 to 12.9 wt. % Si, 0.6 to 1.2 wt. % Cu, 0.8 to 1.5 wt. % Mg, 0.5 to 1.3 wt. % Ni and 0.01 to 0.5 wt. % Sr.

40. The method in accordance with claim 39 wherein said body comprises 0.015 to 0.4 wt. % Sr.

41. The method in accordance with claim 38 wherein step (a) further comprises homogenizing said body at metal temperature of 900°-1100° F. for at least on hour.

42. The method in accordance with claim 41 wherein said homogenizing is performed for two hours or more.

43. The method in accordance with claim 41 wherein said homogenizing is performed for 12 to 20 hours.

44. The method in accordance with claim 38 further comprising:

(g) cutting said rod product to a desired length.

45. The method in accordance with claim 38 wherein said method consists essentially of the steps recited, said rod product having good surface wear resistance without any anodization.

46. The method in accordance with claim 38 wherein said extruding in step (b) is performed at a temperature of 400°-1050° F.

47. The method in accordance with claim 38 further comprising:

(g) hot rolling said extrusion at a temperature of 600°-800° F. after step (b) and before step (c).

48. An aluminum alloy rod product formed by the method of claim 38, said rod product being provided in a T8, T851 or T9 temper.

49. An aluminum alloy piston or valve formed by the method of claim 44, said piston or valve being provided in a T8, T851 or T9 temper and having good surface wear resistance without anodization.

50. A method for producing an aluminum alloy rod product having high resistance to surface wear even without anodization, said method consisting essentially of:

(a) providing an aluminum alloy body comprising 11.3-12.9 wt. % Si, 0.8-1.5 wt. % Mg, 0.6-1.2 wt. % Cu, 0.5-1.3 wt. % Ni and 0.01-0.5 wt. % Sr, max. 1 wt. % Fe, max, 0.1 wt. % Cr, max. 0.2 wt. % Zn, the balance aluminum, incidental elements and impurities;

(b) homogenizing said body at a metal temperature of 900°-1100° F. for at least one hour;

(c) extruding said body in a temperature range of 400°-1000° F. to provide an extrusion;

(d) drawing said extrusion to a rod; and (e) solution heat treating, quenching and aging said rod to form a rod product having high resistance to surface wear.

51. The method in accordance with claim 50 wherein said body comprises 0.015-0.4 wt. % Sr.

* * * * *